US006257208B1

(12) United States Patent
Harvey

(10) Patent No.: US 6,257,208 B1
(45) Date of Patent: Jul. 10, 2001

(54) MARINE-VAPOR SEPARATOR

(75) Inventor: Richard W. Harvey, Logansport, IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 0 days.

(21) Appl. No.: 09/375,727

(22) Filed: Aug. 17, 1999

(51) Int. Cl.[7] ..... F02M 37/04
(52) U.S. Cl. ..... 123/516; 123/456
(58) Field of Search ..... 123/516, 514, 123/456, 518, 519, 520

(56) References Cited

U.S. PATENT DOCUMENTS

| | | | | |
|---|---|---|---|---|
| 2,599,699 | * | 6/1952 | Dilworth | 123/516 |
| 4,195,608 | | 4/1980 | Sanada et al. | 123/136 |
| 4,385,615 | | 5/1983 | Keane | 123/514 |
| 4,411,239 | | 10/1983 | Kelch | 123/557 |
| 4,440,138 | | 4/1984 | Smith | 123/557 |
| 4,452,213 | * | 6/1984 | Duprez | 123/516 |
| 4,454,851 | | 6/1984 | Bourbonnaud et al. | 123/557 |
| 4,524,744 | * | 6/1985 | Adams | 123/459 |
| 4,543,938 | | 10/1985 | Szlaga | 123/514 |
| 4,844,043 | | 7/1989 | Keller | 123/516 |
| 4,989,568 | * | 2/1991 | Sougawa | 123/456 |
| 5,103,793 | * | 4/1992 | Riese et al. | 123/516 |
| 5,115,784 | | 5/1992 | Mito et al. | 123/516 |
| 5,269,276 | | 12/1993 | Brown | 123/514 |
| 5,355,860 | | 10/1994 | Ekstam | 123/516 |
| 5,368,001 | | 11/1994 | Roche | 123/510 |
| 5,375,578 | * | 12/1994 | Kato et al. | 123/516 |
| 5,389,245 | | 2/1995 | Jaeger et al. | 210/129 |
| 5,404,858 | | 4/1995 | Kato | 123/516 |
| 5,647,331 | | 7/1997 | Swanson | 123/516 |
| 5,762,050 | | 6/1998 | Gonzalez | 123/516 |
| 5,765,537 | | 6/1998 | Coleman et al. | 123/514 |
| 5,913,294 | * | 6/1999 | Takahashi et al. | 123/198 DB |

* cited by examiner

*Primary Examiner*—Carl S. Miller
(74) *Attorney, Agent, or Firm*—Howard & Howard

(57) ABSTRACT

A method of controlling fuel temperature while supplying fuel from a fuel tank (12) to an array (16) of fuel injectors of an internal combustion engine (18) comprising the steps of pumping the fuel with a high pressure pump (14), flowing the fuel through a fuel line (20) from the fuel tank (12) to the high pressure pump (14), and flowing the fuel through a vapor separator (22) in the fuel line (20) between the tank (12) and the high pressure pump (14). The method is characterized by recirculating fuel (24) from the vapor separator (22) to the fuel line (20) for leveling fuel temperatures. The method is more specifically characterized by regulating (26) the pressure at which fuel is recirculated from the vapor separator (22) to the fuel line (20). An assembly for implementing the method includes a unitary housing comprising an upper cap (44) and a lower cap (46) for supporting the filter (32), the low pressure pump (28), the first pressure regulator (26), and the vapor separator (22). A baffle (68) is disposed at the bottom of the vapor separator (22) for separating fuel flow from the low pressure pump (28) on a first side of the baffle (68) from fuel returned by the return line (34) disposed on the second side of the baffle (68). The first pressure regulator (26) and the recirculation line (24) are also disposed on the first side of the baffle (68).

30 Claims, 4 Drawing Sheets

MARINE-VAPOR SEPARATOR

BACKGROUND OF THE INVENTION

1. Field of the Invention

The subject invention relates to a system for supplying fuel to an internal combustion engine, and, more specifically, addresses the problem of controlling the temperature of the fuel at the vapor separator in such a system.

2. Description of the Prior Art

The prior art is replete with systems employing components for controlling the fuel temperature in a fuel supply system for an internal combustion engine. Examples of such systems are disclosed in U.S. Pat. No. 4,411,239, to Kelch and U.S. Pat. No. 4,454,851 to Bourbonnaud et al. However, there remains a need for alternative methods of controlling the temperature of the supply of fuel to wide variety of internal combustion engines.

SUMMARY OF THE INVENTION AND ADVANTAGES

The subject invention controls fuel temperature while supplying fuel from a fuel tank to an array of fuel injectors of an internal combustion engine by pumping the fuel with a high pressure pump, flowing the fuel through a fuel line from the fuel tank to the high pressure pump, and flowing the fuel through a vapor separator in the fuel line between the tank and the high pressure pump. The method is characterized by recirculating fuel from the vapor separator to the fuel line for leveling fuel temperatures.

The invention is practiced in a fuel supply system comprising; a fuel tank, a high pressure pump for supplying fuel to a fuel injection array, a fuel line for fuel flow from the tank to the high pressure pump, and a vapor separator in the fuel in between the tank and the high pressure pump. The system is characterized by a recirculation line for recirculating fuel from the vapor separator to the fuel line for leveling fuel temperatures.

Accordingly, the subject invention provides a system wherein the temperature of the fuel is controlled, yet with very little additional cost.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
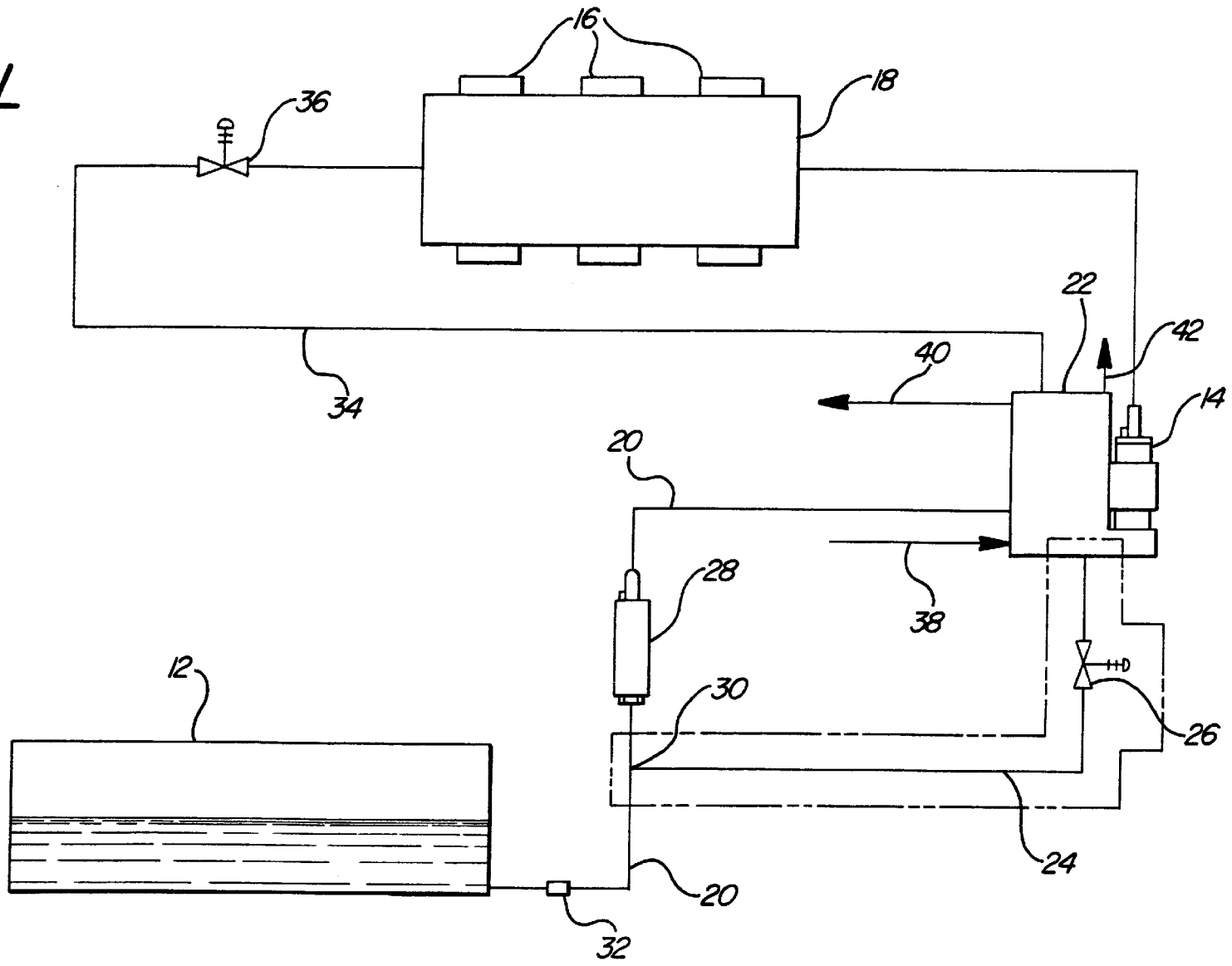
FIG. 1 is a schematic diagram of the subject invention.

Referring to the Figures, wherein like numerals indicate like or corresponding parts throughout the several views, a fuel supply system for an internal combustion engine in is illustrated schematically in FIG. 1.

The fuel supply system includes a fuel tank 12 and a high pressure pump 14 for supplying fuel to a fuel injector array 16 of an internal combustion engine 18. A fuel line 20 establishes fuel flow from the tank 12 to the high pressure pump 14. A vapor separator 22 is disposed in the fuel line 20 between the tank 12 and the high pressure pump 14.

The system is characterized by a recirculation line 24 for recirculating fuel from the vapor separator 22 to the fuel line 20 for leveling fuel temperatures. In other words, the heating of the fuel to cause vapors is a notorious problem in such systems and the subject invention alleviates this problem by the recirculation line 24. In order to control the recirculation, a first pressure regulator 26 is disposed in the recirculation line 24 for regulating the pressure at which fuel is recirculated from the vapor separator 22 to the fuel line 20.

The system also includes a low pressure pump 28 in the fuel line 20 for pumping fuel from the tank 12 to the vapor separator 22. The recirculation line 24 feeds recirculated fuel into the fuel line 20 at a juncture 30 therewith which is between the tank 12 and the low pressure pump 28, i.e., the recirculation line 24 feeds the low pressure pump 28.

A filter 32 is disposed in the fuel line 20 between the tank 12 and the juncture 30 with the recirculation line 24. A return line 34 is included for returning fuel from the injector array to the vapor separator 22. A second pressure regulator 36 is disposed in the return line 34 for regulating the pressure of the fuel returned to the vapor separator 22. The heat from the heated fuel returned from the engine is cooled by water around the vapor separator 22 entering a cooling jacket through a water inlet 38 and exiting through a water outlet 40.

A vapor vent 42 extends from the vapor separator 22 for exiting vapors back to the system, e.g., the tank 12.

Figure 2:
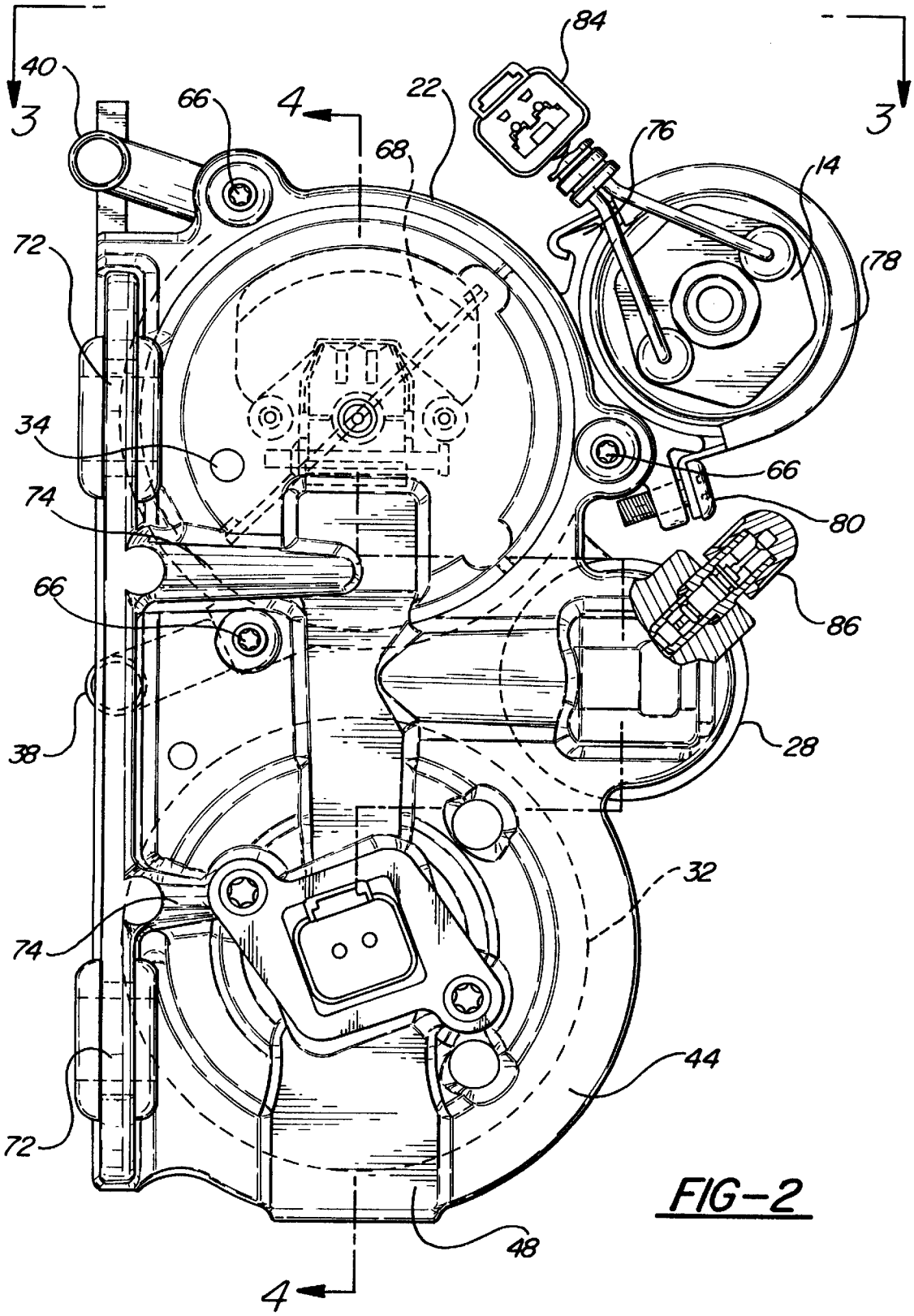
FIG. 2 is top view of an assembly incorporating the subject invention.
Figure 3:
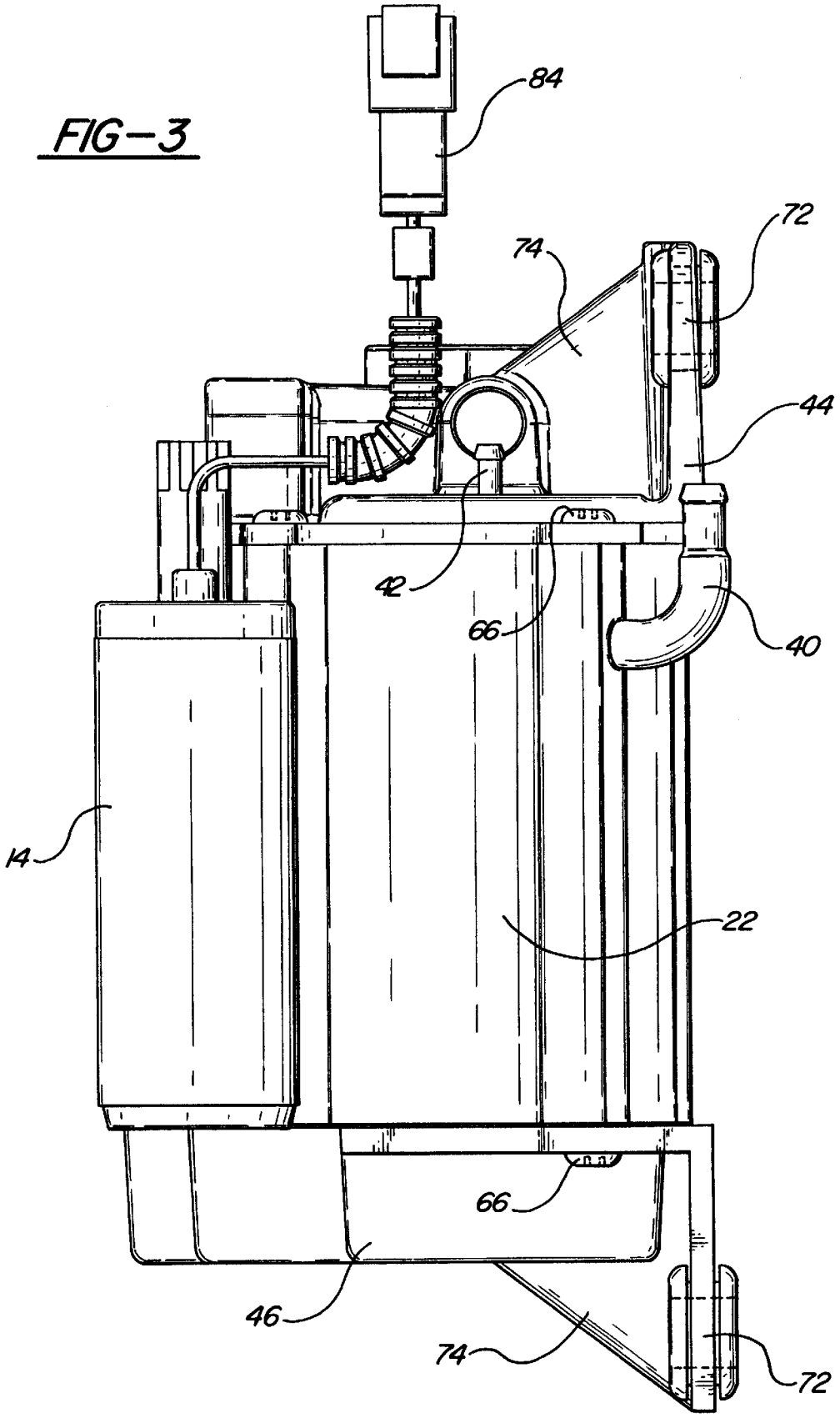
FIG. 3 is a side view taken along line 3—3 of FIG. 2.
Figure 4:
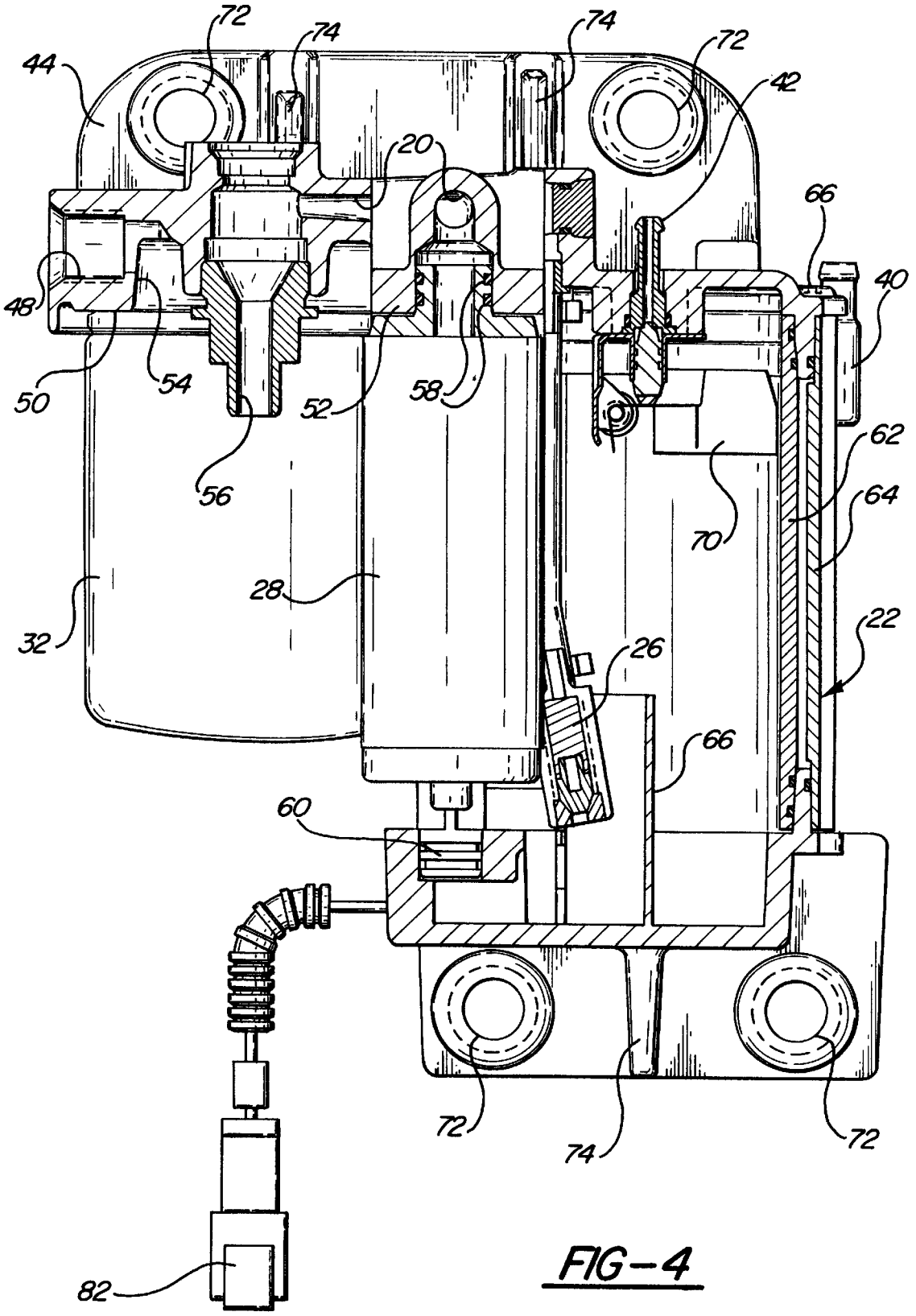
FIG. 4 is a cross sectional view taken along line 4—4 of FIG. 2.

An assembly for implementing the components is shown in FIGS. 2–4. The assembly includes a unitary housing comprising an upper cap 44 and a lower cap 46 for supporting the filter 32, the low pressure pump 28, the first pressure regulator 26, and the vapor separator 22. More specifically, the upper cap 44 defines a fuel inlet 48 for connection to the fuel line 20 from the tank 12 and a first receiving mount 50 in sealing engagement with the filter 32. The upper cap 44 also defines a second receiving mount 52 in sealing engagement with the top of the low pressure pump 28. In addition, the upper cap 44 defines a filter inlet 54 for delivering fuel to the filter 32 and a filter outlet 56 for conveying fuel from the filter 32 through the second receiving mount 52 to the low pressure pump 28. The upper end of the the low pressure pump 28 includes a snout with o-rings 58 disposed thereabout and in sealing engagement with a female recess in the upper cap 44. Likewise, the lower end of the low pressure pump 28 includes a snout 60 in sealing engagement with a third mount defined by the lower cap 46.

The vapor separator 22 includes a cylindrical separator wall 62 extending between and in sealing engagement with the upper 44 and lower 46 caps. A cylindrical jacket 64 extends between the upper 44 and lower 46 caps and is spaced from the separator wall 62 to define a water jacket 64 surrounding the separator wall 62. Bolts 66 interconnect the upper 44 and lower 46 caps to cylindrical jacket 64 and sandwich or clamp the low pressure pump 28, cylindrical separator wall 62 between the upper 44 and lower 46 caps. The water jacket 64 includes the water inlet 38 to the separator wall 62 and the water outlet 40. The cylindrical separator wall 62 defines a separator chamber having a top adjacent the upper cap 44 and a bottom adjacent the lower cap 46. The vapor vent 42 extends from the top of the chamber for exiting vapors from the top of the chamber.

A baffle 68 is disposed at the bottom of the separator chamber for separating fuel flow from the low pressure pump 28 on a first side of the baffle 68 from fuel on the bottom of the chamber on a second side of the baffle 68, i.e., fuel from the return line 34 which is disposed on the second side of the baffle 68. The first pressure regulator 26 is disposed adjacent the bottom of the separator chamber on the first side of the baffle 68. The recirculation line 24 is also disposed on the first side of the baffle 68.

A float valve 70 is disposed at the top of the separator chamber for opening and closing the vapor vent 42 in response to the level of fuel in the separator chamber, i.e., the vent 42 is closed by the float valve 70 when the separator chamber is full of fuel.

The upper 44 and lower 46 caps each include mounting connectors 72 defined by flanges having openings therein for mounting the housing to a support structure. As illustrated, grommets are disposed in each of the openings defining the connectors 72. Reinforcing webs 74 interconnect the flanges and the remainder of the upper 44 and lower 46 caps. In addition, the upper cap 44 includes a saddle 76 for receiving the high pressure pump 14 whereby a strap 78 and bolt 80 hold or mount the pump 14 in the saddle 76, thereby combining the entire system into a unitary or interconnected package.

An electrical connector 82 supplies electrical power to the low pressure pump 28 and an electrical connector 84 supplies electrical power to the high pressure pump 14. A diagnostic port 86 is provided for testing purposes. A plug 88 seals the fuel inlet passage 20 in the upper cap 44.

The subject invention also provides a method of controlling fuel temperature while supplying fuel from a fuel tank 12 to an array 16 of fuel injectors of an internal combustion engine 18 comprising the steps of flowing the fuel through a fuel line 20 from the fuel tank 12 to the array 16 of fuel injectors and flowing the fuel through a vapor separator 22 in the fuel line 20 between the tank 12 and to the array 16 of fuel injectors. The method is characterized by recirculating fuel 24 from the vapor separator 22 to the fuel line 20 for leveling fuel temperatures. pumping the fuel with a high pressure pump 14. The method is more specifically characterized by regulating 26 the pressure at which fuel is reticulated from the vapor separator 22 to the fuel line 20.

The method is further defined by including the step of pumping the fuel with a high pressure pump 14 from the vapor separator 22 to the array 16 of fuel injectors, pumping fuel from the tank 12 to the vapor separator 22 with a low pressure pump 28, and feeding reticulated fuel into the fuel line 20 at a juncture 30 therewith which is between the tank 12 and the low pressure pump 28.

The method also employs the steps of filtering 32 the fuel in the fuel line 20 between the tank 12 and the juncture 30 with the recirculating line 24, returning fuel from the injector array 16 to the vapor separator 22, and regulating 36 the pressure of the fuel returned to the vapor separator 22.

The method includes dividing the vapor separator (22) with a baffle 68 on the bottom of the chamber and separating fuel flow from the low pressure pump (28) on a first side of a baffle 68 from fuel on the bottom of a chamber on a second side of the baffle 68. The returning (34) of fuel from the injector array to the vapor separator (22) is returned to the second side of the baffle 68 because this returned fuel is usually hot and foamy. The recirculating of fuel (24) from the vapor separator (22) is also from the first side of the baffle 68.

The vapor separator 22 is cooled by water flowing around the cylindrical jacket 64 of the separator 22, into the separator 22 through the water inlet 38 and out through the water outlet 40.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims, wherein that which is prior art is antecedent to the characterized novelty and reference numerals are merely for convenience and are not to be in any way limiting, the invention may be practiced otherwise than as specifically described.

What is claimed is:

1. A fuel supply system for an internal combustion engine comprising;

a fuel tank (12), a pump (14 or 28) for supplying fuel to a fuel injector array (16), a fuel line (20) for establishing fuel flow from said tank (12) to said high pressure pump (14), a vapor separator (22) in said fuel line (20) between said tank (12) and said pump (14), a recirculating line (24) for recirculating fuel from said vapor seperator (22) to said fuel line (20) for leveling fuel temperatures, and a first pressure regulator (26) in said recirculating line (24) for regulating the pressure at which fuel is reticulated from said vapor separator (22) to said fuel line (20).

2. A system as set forth in claim 1 wherein said pump comprises a high pressure pump (14) in said fuel line (20) for supplying fuel to a fuel injector array (16), and including a low pressure pump (28) upstream of said high pressure pump (14) in said fuel line (20) for pumping fuel from said tank (12) to said vapor separator (22).

3. A system as set forth in claim 1 wherein said recirculating line (24) feeds reticulated fuel into said fuel line (20) at a juncture (30) therewith which is between said tank (12) and said low pressure pump (28).

4. A system as set forth in claim 3 including a filter (32) in said fuel line (20) between said tank (12) and said juncture (30) with said recirculating line (24).

5. A system as set forth in claim 4 including a return line (34) for returning fuel from the injector array (16) to said vapor separator (22).

6. A system as set forth in claim 5 including a second pressure regulator (36) in said return line (34) for regulating the pressure of the fuel returned to said vapor separator (22).

7. A system as set forth in claim 4 including a unitary housing supporting said filter (32), a low pressure pump (28), said first pressure regulator (26), and said vapor separator (22).

8. A system as set forth in claim 7 wherein said vapor separator (22) defines a separator chamber having a top and a bottom, said first pressure regulator (26) being disposed adjacent said bottom of said separator chamber.

9. A system as set forth in claim 8 including a baffle (68) at the bottom of said separator chamber for separating fuel flow from said low pressure pump (28) on a first side of said baffle (68) from fuel on the bottom of said chamber on a second side of said baffle.

10. A system as set forth in claim 9 wherein said recirculating line (24) is disposed on said first side of said baffle (68).

11. A system as set forth in claim 10 wherein said first pressure regulator (26) is disposed on said first side of said baffle (68).

12. A system as set forth in claim 10 wherein said wherein said return line (34) is disposed on said second side of said baffle (68).

13. A system as set forth in claim 12 including a vapor vent for exiting vapors from said top of said chamber.

14. A system as set forth in claim 13 including a float valve (70) at said top of said chamber for opening and closing said vapor vent in response to the level of fuel in said chamber.

15. A system as set forth in claim 14 wherein said housing includes an upper cap (44) member defining a fuel inlet for connection to said fuel line (20) from said tank (12), said upper cap (44) defining a first receiving mount (50) in sealing engagement with said filter (32) and a second receiving mount (52) in sealing engagement with said low pressure pump (28), said upper cap (44) defining a filter inlet (54) for delivering fuel to said filter (32) and a filter outlet (56) for conveying fuel from said filter (32) through said second receiving mount (52) to said low pressure pump (28).

16. A system as set forth in claim 15 wherein said housing includes a lower cap (46) defining a third mount in sealing engagement with said low pressure pump (28) and into said chamber.

17. A system as set forth in claim 16 wherein said separator includes a separator wall (62) extending between and in sealing engagement with said upper (44) and lower (46) caps.

18. A system as set forth in claim 17 wherein said separator includes a jacket (64) extending between said upper (44 and lower 46) caps and spaced from said separator wall (62) to define a water jacket (64) surrounding said separator wall (62).

19. A system as set forth in claim 18 wherein said lower cap (46) includes a water inlet (38) to said water jacket (64) and said upper cap (44) includes a water outlet (40) from said water jacket (64).

20. A system as set forth in claim 19 wherein said upper (44 and lower 46) caps each include mounting connectors (72) for mounting said housing to a support structure.

21. A method for supplying fuel from a fuel tank (12) to an array (16) of fuel injectors of an internal combustion engine (18), said method comprising the steps of;

flowing the fuel through a fuel line (20) from the fuel tank (12) to the array (16) of fuel injectors, flowing the fuel through a vapor separator (22) in the fuel line (20) between the tank (12) and to the away (16) of fuel injectors, recirculating fuel (24) from the vapor separator (22) to the fuel line (20) for leveling fuel temperatures, and regulating (26) the pressure at which fuel is reticulated from the vapor separator (22) to the fuel line (20).

22. A method as set forth in claim 21 including the steps of pumping the fuel with a high pressure pump (14) from the vapor separator (22) to the array (16) of fuel injectors, pumping fuel from the tank (12) to the vapor separator (22) with a low pressure pump (28).

23. A method as set forth in claim 22 including the step of feeding reticulated fuel into the fuel line (20) at a juncture (30) therewith which is between the tank (12) and the low pressure pump (28).

24. A method as set forth in claim 23 including the step of filtering (32) the fuel in the fuel line (20) between the tank (12) and the juncture (30) with the recirculating line (24).

25. A method as set forth in claim 24 including the step of returning (34) fuel from the injector array to the vapor separator (22).

26. A method as set forth in claim 22 including the step of regulating (36) the pressure of the fuel returned from the injector array to the vapor separator (22).

27. A method as set forth in claim 25 including dividing the vapor separator (22) with a baffle (68) on the bottom of the chamber and separating fuel flow from the low pressure pump (28) on a first side of a baffle (68) from fuel on the bottom of a chamber on a second side of the baffle.

28. A method as set forth in claim 27 wherein said recirculating fuel (24) from the vapor separator (22) is further defined as recirculating fuel (24) from the first side of the baffle (68).

29. A method as set forth in claim 28 wherein the returning (34) of fuel from the injector array to the vapor separator (22) is returned to the second side of the baffle (68).

30. A system as set forth in claim 29 including circulating water around the vapor separator for cooling.

* * * * *